US009714810B1

(12) United States Patent
Nowlin

(10) Patent No.: US 9,714,810 B1
(45) Date of Patent: Jul. 25, 2017

(54) RIFLE SLING

(71) Applicant: Kenny Nowlin, Loveland, CO (US)

(72) Inventor: Kenny Nowlin, Loveland, CO (US)

( * ) Notice: Subject to any disclaimer, the term of this patent is extended or adjusted under 35 U.S.C. 154(b) by 170 days.

(21) Appl. No.: 14/715,828

(22) Filed: May 19, 2015

(51) Int. Cl.
*F41C 33/02* (2006.01)
*F41C 33/00* (2006.01)

(52) U.S. Cl.
CPC ..... *F41C 33/002* (2013.01); *F41C 33/001* (2013.01)

(58) Field of Classification Search
CPC ..... F41C 33/001; F41C 33/002
USPC ..... 224/150, 637–641, 262
See application file for complete search history.

(56) References Cited

U.S. PATENT DOCUMENTS 1,198,202 A * 9/1916 Drinkard ..... A01K 97/10 224/200
3,653,564 A 4/1972 Carter
D311,813 S 11/1990 Oliver
5,664,721 A 9/1997 Homeyer
5,669,170 A * 9/1997 Norris ..... F41C 33/00 224/150
5,806,742 A 9/1998 Mott
6,068,167 A 5/2000 Hopson
6,923,357 B2 * 8/2005 Smith ..... A01K 97/06 224/251
7,082,709 B2 8/2006 Lindsey
7,959,046 B2 6/2011 Burnsed, Jr.
8,418,899 B1 * 4/2013 Stamps ..... A45F 3/14 224/251
2005/0040199 A1 * 2/2005 Lemens ..... A45F 3/14 224/637
2007/0145092 A1 * 6/2007 Eberle ..... A45F 3/04 224/650
2009/0321484 A1 12/2009 Schweikert

FOREIGN PATENT DOCUMENTS

EP 2244048 10/2010

* cited by examiner

*Primary Examiner* — Corey Skurdal
(74) *Attorney, Agent, or Firm* — Kyle A. Fletcher, Esq.

(57) ABSTRACT

The rifle sling is a backpack style rifle sling. The rifle sling secures the rifle in a two point back mounted holster that runs along the center of the back along the spine. The rifle sling comprises a chest harness and a rifle sling.

9 Claims, 4 Drawing Sheets

RIFLE SLING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of rifle sling carriers, more specifically, a harness configured for use as a rifle sling.

SUMMARY OF INVENTION

The rifle sling is a backpack style rifle sling. The rifle sling secures the rifle in a two point back mounted rifle holster that runs along the center of the back along the spine.

These together with additional objects, features and advantages of the rifle sling will be readily apparent to those of ordinary skill in the art upon reading the following detailed description of the presently preferred, but nonetheless illustrative, embodiments when taken in conjunction with the accompanying drawings.

In this respect, before explaining the current embodiments of the rifle sling in detail, it is to be understood that the rifle sling is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rifle sling.

It is therefore important that the claims be regarded as including such equivalent construction insofar as they do not depart from the spirit and scope of the rifle sling. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
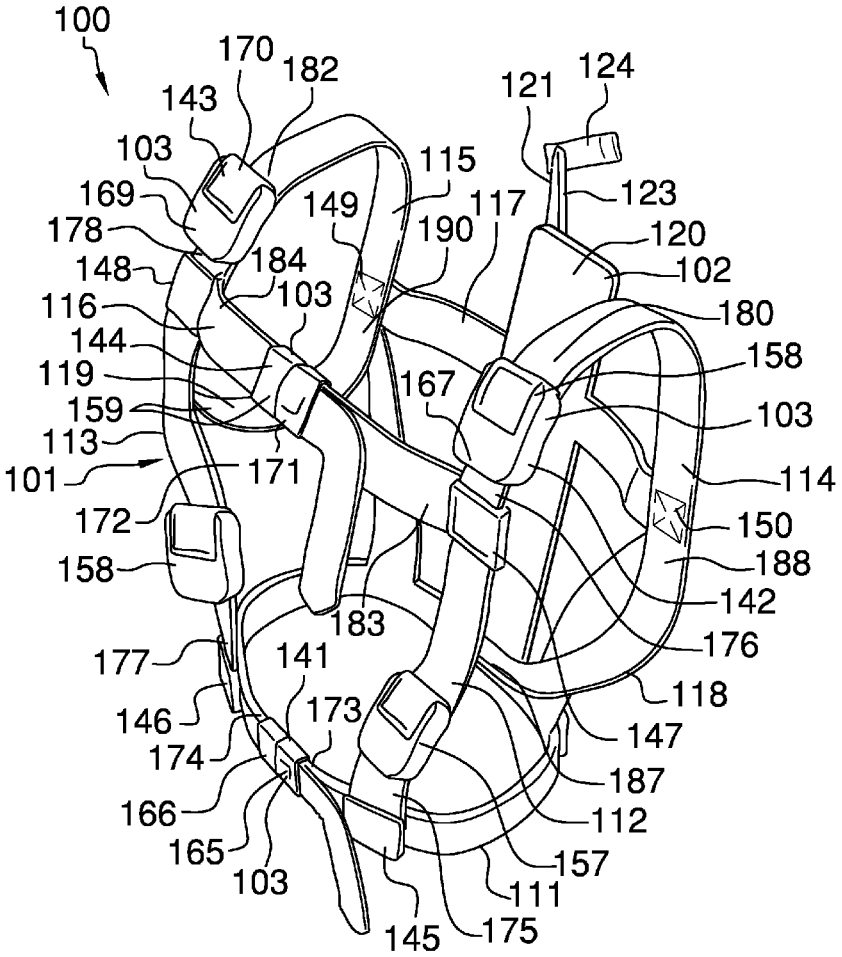
FIG. 1 is a perspective view of an embodiment of the disclosure.
Figure 2:
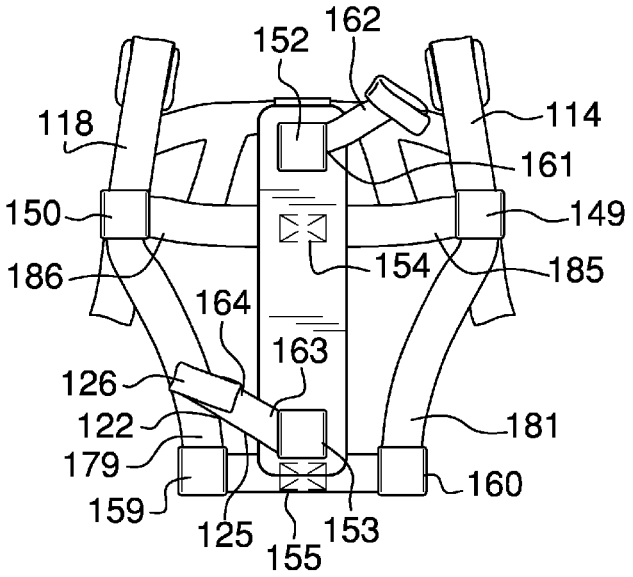
FIG. 2 is a back view of an embodiment of the disclosure.
Figure 3:
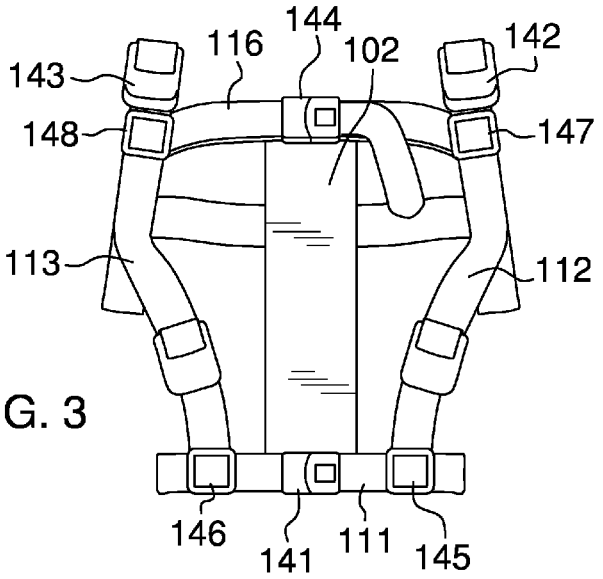
FIG. 3 is a front view of an embodiment of the disclosure.
Figure 4:
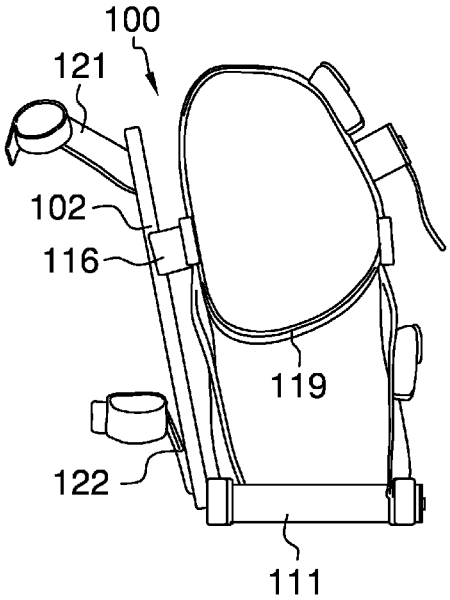
FIG. 4 is a side view of an embodiment of the disclosure.
Figure 5:
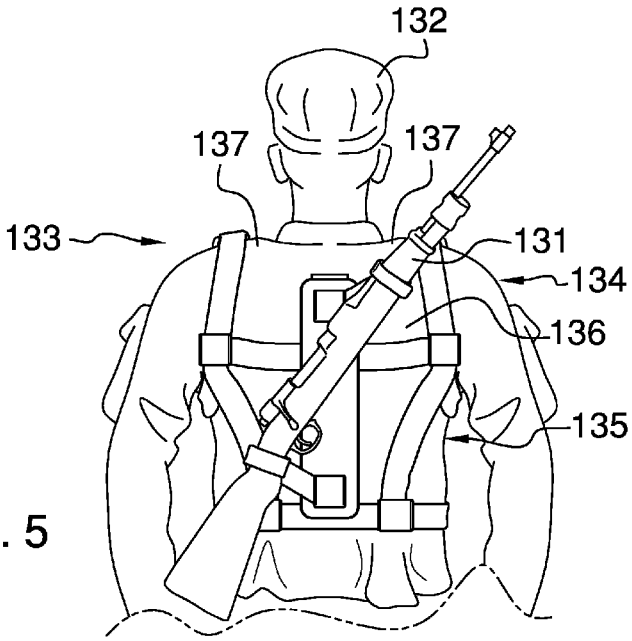
FIG. 5 is an in-use view of an embodiment of the disclosure.
Figure 6:
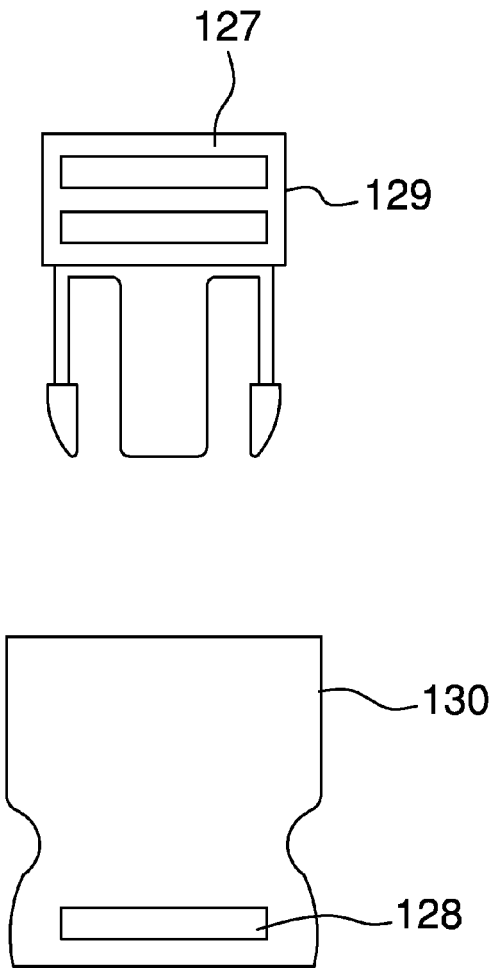
FIG. 6 is a detail view of an embodiment of the disclosure.

Detailed reference will now be made to a first potential embodiment of the disclosure, which is illustrated in FIGS. 1 through 6. The rifle sling 100 (hereinafter invention) comprises a chest harness 101 and a rifle holster 102.

The rifle holster 102 comprises a rifle pad 120, an upper weapon strap 121 and a lower weapon strap 122. The rifle pad 120 is a rectangular padded piece of fabric. The purpose of the rifle pad 120 is to pad the area between the user 132 and the rifle 131 to prevent injury to the user 132 and damage to the rifle 131. The rifle 131 is attached to the rifle holster 102 using an upper weapon strap 121 and a lower weapon strap 122. The upper weapon strap 121 further comprises an upper base strap 123 and an upper hook and loop fastener 124. The upper base strap 123 is a piece of webbing that is further defined with a twenty first end 161 and a twenty second end 162. The upper hook and loop fastener 124 is sewn to the twenty second 162 end of the upper base strap 123. The twenty first end 161 of the upper base strap 123 is sewn to the rifle pad 120 using a twelfth sewn seam 152.

The lower weapon strap 122 further comprises a lower base strap 125 and a lower hook and loop fastener 126. The lower base strap 125 is a piece of webbing that is further defined with a twenty third end 163 and a twenty fourth end 164. The lower hook and loop fastener 126 is sewn to the twenty fourth 164 end of the lower base strap 125. The twenty third end 163 of the lower base strap 125 is sewn to the rifle pad 120 using a thirteenth sewn seam 153. The rifle holster 102 is joined to the chest harness 101 at the rear chest strap 115 using a fourteenth sewn seam 154. The rifle holster 102 is joined to the chest harness 101 at the belt loop 111 using a fifteenth sewn seam 155.

The chest harness 101 further comprises a belt loop 111, a left front strap 112, a right front strap 113, a left rear strap 114, a right rear strap 115, a front chest strap 116, a rear chest strap 117, an optional left under arm loop 118, an optional right under arm loop 119, a seventeenth pocket 157, an eighteenth pocket 158, and a plurality of buckles 103.

Each of the plurality of buckles 103 is a commercially available side release buckle that further comprises a male buckle 129 and a female buckle 130. Each of the male buckles 129 further comprises a slip lock tri-glide 127 that can be used to adjust the tension on the joined straps. Each of the female buckles 130 further comprises a attachment loop 128 that is used to attach the loose end of a strap to the female buckle 130. This is done by threading the strap through the attachment loop 128 and sewing the loose end of the strap back onto the strap itself. In a second potential embodiment of the disclosure, each of the female buckles 130 further comprises a slip lock tri-glide 127 that can be used to adjust the tension on the joined straps. The design and use of buckles is well known and documented in the sewing arts. Methods to attach buckles to straps are well known and documented in the sewing arts. The design and use of slip lock tri-glides 127 is well known and documented in the sewing arts. Methods to attach slip lock tri-glides 127 to straps are well known and documented in the sewing arts. The use of slip lock tri-glides 127 in buckles is well known and documented in the sewing arts. Methods to attach slip lock tri-glides 127 to straps are well known and documented in the sewing arts.

The plurality of buckles 103 further comprises a first buckle 141, a second buckle 142, a third buckle 143 and a fourth buckle 144. The first buckle 141 further comprises a twenty fifth male buckle 165 and a twenty sixth female buckle 166. The second buckle 142 further comprises a twenty seventh 167 male buckle and a twenty eighth female buckle 168. The third buckle 143 further comprises a twenty ninth male buckle 169 and a thirtieth female buckle 170. The fourth buckle 144 further comprises a thirty first male buckle 171 and a thirty second female buckle 172.

The seventeenth pocket 157 and eighteenth pocket 158 are both fabric containers that are sewn on the left front strap 112 and the right front strap 113 respectively. The purpose of the seventeenth pocket 157 and eighteenth pocket 158 are to carry hunting accessories.

The belt loop 111 is a strap formed from webbing. The belt loop 111 is further defined with a thirty third end 173 and a thirty fourth end 174. The purpose of the belt loop 111 is to secure the invention 100 around the waist of the user 132. The thirty third end 173 of the belt loop 111 is attached to the twenty fifth male buckle 165. The thirty fourth end 174 is attached to the twenty sixth female buckle 166.

The left front strap 112 is a strap formed from webbing. The left front strap 112 is further defined with a thirty fifth end 175 and a thirty sixth end 176. The purpose of the left front strap 112 is to support the invention 100 on the left 133 shoulder 137 of the user 132. The left front strap 112 runs down the left 133 side of the user's 132 chest 135. The thirty fifth 175 end of the left front strap 112 is joined to the belt loop 111 at the fifth sewn seam 145. The thirty sixth 176 end is attached to the twenty seventh male buckle 167.

The right front strap 113 is a strap formed from webbing. The right front strap 113 is further defined with a thirty seventh end 177 and a thirty eighth end 178. The purpose of the right front strap 113 is to support the invention 100 on the right 134 shoulder 137 of the user 132. The right front strap 113 runs down the right 134 side of the user's 132 chest 135. The thirty seventh end 177 of the right front strap 113 is joined to the belt loop 111 at the sixth sewn seam 146. The thirty eighth end 178 of the right front strap 113 is attached to the twenty ninth male buckle 169.

The left rear strap 114 is a strap formed from webbing. The left rear strap 114 is further defined with a thirty ninth end 179 and a fortieth end 180. The purpose of the left rear strap 114 is to support the invention 100 on the left 133 shoulder 137 of the user 132. The left front strap 112 runs down the left 133 side of the user's 132 back 136. The thirty ninth end 179 of the left rear strap 114 is joined to the belt loop 111 at the nineteenth sewn seam 159. The fortieth end 180 of the left rear strap 114 is attached to the twenty eighth female buckle 168.

The right rear strap 115 is a strap formed from webbing. The right rear strap 115 is further defined with a forty first end 181 and a forty second end 182. The purpose of the right rear strap 115 is to support the invention 100 on the right 134 shoulder 137 of the user 132. The right front strap 113 runs down the right 134 side of the user's 132 back 136. The forty first end 181 of the right rear strap 115 is joined to the belt loop 111 at the twentieth sewn seam 160. The forty second end 182 of the right rear strap 115 is attached to the thirtieth female buckle 170.

The front chest strap 116 is a strap formed from webbing. The front chest strap 116 is further defined with a forty third end 183 and a forty fourth end 184. The purpose of the front chest strap 116 is to connect the left front strap 112 to the right front strap 113. The forty third 183 end of the front chest strap 116 is joined to the left front strap 112 at the seventh sewn seam 147. The forty forth end 184 of the front chest strap 116 is joined to the right front strap 113 at the eighth sewn seam 148. The front chest strap 116 is spliced and the front chest strap 116 is rejoined with the fourth buckle 144.

The rear chest strap 117 is a strap formed from webbing. The rear chest strap 117 is further defined with a forty fifth end 185 and a forty sixth end 186. The purpose of the rear chest strap 117 is to connect the left rear strap 114 to the right rear strap 115. The forty fifth 185 end of the rear chest strap 117 is joined to the left rear strap 114 at the ninth sewn seam 149. The forty sixth end 186 of the rear chest strap 117 is joined to the right rear strap 115 at the tenth sewn seam 150.

The optional left under arm loop 118 is a strap formed from webbing. The optional left under arm loop 118 is further defined with a forty seventh end 187 and a forty eighth end 188. The purpose of the optional left under arm loop 118 is to attach the left front strap 112 to the left rear strap 114 underneath the shoulder 137 of the user 132. The forty seventh end 187 of the optional left under arm loop 118 is joined to the left front strap 112 at the seventh sewn seam 147. The forty eighth end 188 of the optional left under arm loop 118 is joined to the left rear strap 114 at the tenth sewn seam 150.

The optional right under arm loop 119 is a strap formed from webbing. The optional right under arm loop 119 is further defined with a forty ninth end 189 and a fiftieth end 190. The purpose of the optional right under arm loop 119 is to attach the right front strap 113 to the left rear strap 114 underneath the shoulder 137 of the user 132. The forty ninth end 189 of the optional right under arm loop 119 is joined to the right front strap 113 at the eighth sewn seam 148. The fiftieth end 190 of the optional right under arm loop 119 is joined to the right rear strap 115 at the ninth sewn seam 149.

To prepare the invention for use 100, the rifle 131 is attached to the rifle holster 102 by using the upper hook and loop fastener 124 to secure the rifle 131 to the upper weapon strap 121 and using the lower hook and loop fastener 126 to secure the rifle 131 to the lower weapon strap 122. The twenty seventh male buckle 167 is inserted into the twenty eighth female buckle 168. The twenty ninth male buckle 169 is inserted into the thirtieth female buckle 170. The invention 100 can now be placed on the user 132 so that the second buckle 142 rests on the left 133 shoulder 137 of the user 132 and the third buckle 143 rests on the right 134 shoulder 137 of the user 132. The twenty fifth male buckle 165 is inserted into the twenty sixth female buckle 166. The thirty first male buckle 171 is inserted into the thirty second female buckle 172. The fit of the invention 100 is adjusted by adjusting the slip lock tri-glides 127 associated with the first buckle 141, second buckle 142, third buckle 143 and the fourth buckle 144.

Webbing is commercially available. Side release buckles are commercially available. Sewing machines and yarns for sewing are commercially available.

The following definitions and directional references were used in this disclosure:

Buckle: As used in this disclosure, a buckle is a fastening that is used for joining a first loose end of a strap to a second loose end of the same strap or a different strap. A buckle further comprises a male buckle that is attached to the first loose end and a female buckle that is attached to the second loose end. The male buckle has a pin or other structure that is generally caught by a structure formed in the female buckle.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface 107, the plurality of minute hooks fasten to the plurality of loops securely fastening the hook surface to the loop surface.

Strap: As used in this disclosure a strap is a strip of leather, cloth, or other flexible material, often with a buckle, that is used to fasten, secure, carry, or hold onto something.

Textile: As used in this disclosure, a textile is a material that is woven, knitted or felted. Synonyms in common usage for this definition of textile include fabric and cloth.

Webbing: As used in this disclosure, a webbing is strong, close woven fabric that is used for straps or belting. As used in this disclosure, webbing is a fully formed material that is only cut for to length for use. Webbing is not formed by cutting broader materials into strips.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rifle sling comprising:

a chest harness and a rifle holster;

wherein the rifle holster is back mounted;

wherein the chest harness comprises multiple straps;

wherein the chest harness is adjustable;

wherein the rifle holster comprises a rifle pad, an upper weapon strap and a lower weapon strap;

wherein the rifle pad is a rectangular padded piece of fabric;

wherein the upper weapon strap further comprises an upper base strap and an upper hook and loop fastener;

wherein the lower weapon strap further comprises a lower base strap and a lower hook and loop fastener;

wherein the chest harness further comprises a belt loop, a left front strap, a right front strap, a left rear strap, a right rear strap, a front chest strap, a rear chest strap, a seventeenth pocket, an eighteenth pocket, and a plurality of buckles;

wherein each of the plurality of buckles is a commercially available side release buckle that further comprises a male buckle and a female buckle;

wherein a slip lock tri-glide is formed in each of the plurality of buckles in a location selected from a group consisting of the male buckle or the female buckle;

wherein an attachment loop is formed in each of the plurality of buckles in a location selected from a group consisting of the male buckle or the female buckle;

wherein the plurality of buckles is further defined with a first buckle, a second buckle, a third buckle and a fourth buckle;

wherein the first buckle is further defined with a twenty fifth male buckle and a twenty sixth female buckle;

wherein the second buckle is further defined with a twenty seventh male buckle and a twenty eighth female buckle;

wherein third buckle is further defined with a twenty ninth male buckle and a thirtieth female buckle;

wherein the fourth buckle is further defined with a thirty first male buckle and a thirty second female buckle;

wherein the seventeenth pocket is a fabric containers attached to the left front strap;

wherein the eighteenth pocket is a fabric containers attached to the right front strap;

wherein the belt loop is a strap formed from webbing;

wherein the belt loop is further defined with a thirty third end and a thirty fourth end;

wherein the thirty third end of the belt loop is attached to the twenty fifth male buckle;

wherein the thirty fourth end of the belt loop is attached to the twenty sixth female buckle;

wherein the left front strap is a strap formed from webbing;

wherein the left front strap is further defined with a thirty fifth end and a thirty sixth end;

wherein the thirty fifth end of the left front strap is joined to the belt loop at a fifth sewn seam;

wherein the thirty sixth end is attached to the twenty seventh male buckle;

wherein the right front strap is a strap formed from webbing;

wherein the right front strap is further defined with a thirty seventh end and a thirty eighth end;

wherein the thirty seventh end of the right front strap is joined to the belt loop at a sixth sewn seam;

wherein the thirty eighth end of the right front strap is attached to the twenty ninth male buckle.

2. The rifle sling according to claim 1 wherein the left rear strap is a strap formed from webbing;

wherein the left rear strap is further defined with a thirty ninth end and a fortieth end;

wherein the thirty ninth end of the left rear strap is joined to the belt loop at a nineteenth sewn seam;

wherein the fortieth end of the left rear strap is attached to the twenty eighth female buckle.

3. The rifle sling according to claim 2 wherein the right rear strap is a strap formed from webbing;

wherein the right rear strap is further defined with a forty first end and a forty second end;

wherein the forty first end of the right rear strap is joined to the belt loop at a twentieth sewn seam;

wherein the forty second end of the right rear strap is attached to the thirtieth female buckle.

4. The rifle sling according to claim 3 wherein the front chest strap is a strap formed from webbing;

wherein a forty third end of the front chest strap is joined to the left front strap at a seventh sewn seam;

wherein a forty forth end of the front chest strap is joined to the right front strap at an eighth sewn seam;

wherein the front chest strap is spliced and rejoined with the fourth buckle.

5. The rifle sling according to claim 4 wherein the rear chest strap is a strap formed from webbing wherein a forty fifth end of the rear chest strap is joined to the left rear strap at a ninth sewn seam;

wherein a forty sixth end of the rear chest strap is joined to the right rear strap at a tenth sewn seam.

6. The rifle sling according to claim 5 wherein the chest harness is further defined with a left under arm loop;

wherein the left under arm loop is a strap formed from webbing;

wherein left under arm loop is further defined with a forty seventh end and a forty eighth end;

wherein the forty seventh end of the left under arm loop is joined to the left front strap at the seventh sewn seam;

wherein the forty eighth end of the left under arm loop is joined to the left rear strap at the tenth sewn seam.

7. The rifle sling according to claim 6 wherein the chest harness is further defined with a right under arm loop;

wherein the right under arm loop is a strap formed from webbing;

wherein the right under arm loop is further defined with a forty ninth end and a fiftieth end;

wherein the forty ninth end of the right under arm loop is joined to the right front strap at the eighth sewn seam;

wherein the fiftieth end of an optional right under arm loop is joined to the right rear strap at the ninth sewn seam.

8. The rifle sling according to claim 7 wherein the rifle holster is joined to the chest harness at the rear chest strap using a fourteenth sewn seam.

9. The rifle sling according to claim 8 wherein the rifle holster is joined to the chest harness at the belt loop using a fifteenth sewn seam.

* * * * *